US005562248A

United States Patent [19]

Khalifka

[11] Patent Number: 5,562,248

[45] Date of Patent: Oct. 8, 1996

[54] SHOWERHEAD WITH INTEGRATED SOAP DISPENSER

[76] Inventor: Mahmound Khalifka, 333 Broadway, Passaic, N.J. 07055

[21] Appl. No.: 364,669

[22] Filed: Dec. 27, 1994

[51] Int. Cl.[6] ..... B05B 7/24

[52] U.S. Cl. ..... 239/316; 239/318; 222/145.5; 4/903

[58] Field of Search ..... 239/318, 316, 239/315, 310; 222/630, 145.5, 145.7; 4/605, 903

[56] References Cited

U.S. PATENT DOCUMENTS

| | | | |
|---|---|---|---|
| 2,462,752 | 2/1949 | Kotches et al. | 239/318 X |
| 2,800,313 | 7/1957 | Targosh et al. | 239/318 |
| 3,003,703 | 10/1961 | Lambton | 239/316 X |
| 3,207,445 | 9/1965 | Court et al. | 239/318 X |
| 3,446,438 | 5/1969 | Watson | 239/318 X |
| 3,801,018 | 4/1974 | Plotz | 239/316 |
| 4,121,773 | 10/1978 | Headen et al. | 239/317 |
| 5,305,476 | 4/1994 | Ohyama et al. | 239/318 X |

*Primary Examiner*—Andres Kashnikow
*Assistant Examiner*—Lesley D. Morris
*Attorney, Agent, or Firm*—M. Silverman

[57] ABSTRACT

A showerhead and soap dispensing system which has improved properties of soap lathering and control thereof. This system includes a frusto-conical body having an internal annular channel in fluid communication with a soap-containing enclosure via a soap-receiving input conduit. This channel has a plurality of output apertures associated therewith. The system also includes a frusto-conical plug having an upstream hollow portion with a multiplicity of exit apertures and a downstream solid portion. The solid portion of the plug and the body form therebetween a lathering chamber. The axial position of the plug will control the lather and water flow characteristics.

6 Claims, 3 Drawing Sheets

SHOWERHEAD WITH INTEGRATED SOAP DISPENSER

BACKGROUND OF THE INVENTION

The present invention relates to a showerhead system and, more particularly, to a system which includes therein means for lathering of liquid soap or detergent dispensed therethrough.

The art of showerheads includes many devices which provide for the attachment or integration thereinto of means for the dispensing or mixing of liquid soap or other cleaning means. The prior art, as best known to the instant inventor, is reflected in U.S. Pat. No. 2,800,313 (1957) to Targosh, entitled Liquid Mixing Nozzle of the Aspirator Type; and No. 3,446,438 (1969) to Watson, entitled Shower Head Mixing Arrangement. These systems are applicable to the present invention in that they make use of venturi principles to effect the mixing of the liquid soap with the showerhead flow.

Notwithstanding such similarities, the above art, as well as other art known to the Applicant, e.g., U.S. Pat. No. 2,562,415 to Chase and No. 4,121,773 to Headen, relate to systems which are neither simple nor economic to manufacture, which are not readily integratable into the showerhead itself, and which do not provide a high degree of lathering of the soap prior to its exit from the outlet of the system. Also, to the degree that the art of record provides a lathering effect, the control or modulation thereof is difficult to adjust.

The instant invention may, therefore, be viewed as a response to the long felt need in the art of showerhead design to provide a showerhead system having integrated liquid soap dispensing means which provides for an effective and adjustable lathering effect thereof.

SUMMARY OF THE INVENTION

The invention relates to a showerhead and soap dispensing system including an input conduit of pressurized water and a refillable liquid soap containing enclosure having an output aperture thereof. The showerhead system further includes a frusto-conical shower head body (SHB) including a venturi defining bore surface, said body including an axial water input at an apex thereof and also including a water output at a base thereof. Said SHB further includes an internal annular channel in a radial plane of said body, said channel having a soap-receiving input, upstream of said channel, in fluid communication with said output aperture of said soap-containing enclosure and having a polar plurality of output apertures in a radial plane downstream of said annular channel. The inventive system further includes a frusto-conical plug including a hollow upstream portion thereof having a mouth proportioned for rotatable registration within said axial water input of said SHB. Said hollow portion of said plug includes, at a downstream radius thereof, a polar multiplicity of water exit apertures disposed, upon registration of said plug into said SHB, upstream of said output apertures of said annular channel of the SHB. Said frusto-conical plug further includes a downstream solid portion thereof integral with said upstream hollow portion and having an external concave surface of rotation which, in combination with said venturi bore surface of said SHB, defines an annular water and soap lathering chamber downstream of said water exit apertures of said hollow upstream plug portion and including, in the radial plane of said plurality of polar output apertures of said internal soap-containing channel of said SHB, a radius of said plug downstream of said soap exit apertures which widens toward said bore surface to maximize fluid pressure in said lathering chamber. Further provided as a part of said frusto-conical plug is an integral rotation control knob upon a downstream-most external radius of said plug. The extent of registration of said upstream end of said plug and the SHB input can be adjusted to thereby modify the axial distance between the radial planes of said soap exit apertures and said water exit apertures to thereby effect the lather and water characteristics of the system.

It is, accordingly, an object of the present invention to provide a shower head and liquid soap dispensing system having improved properties of soap lathering and control thereof.

It is another object to provide an invention of the above type which is simple and economic to manufacture.

It is a further object to provide a showerhead system having a fully integrated liquid soap system.

It is a yet further object to provide a showerhead and soap dispensing system of the above type which is easy to clean and service.

The above and yet other objects and advantages of the present invention will become apparent from the hereinafter set forth Brief Description of the Drawings, Detailed Description of the Invention and claims appended herewith.

DETAILED DESCRIPTION OF THE INVENTION

DETAILED DESCRIPTION OF THE INVENTION

Figure 1:
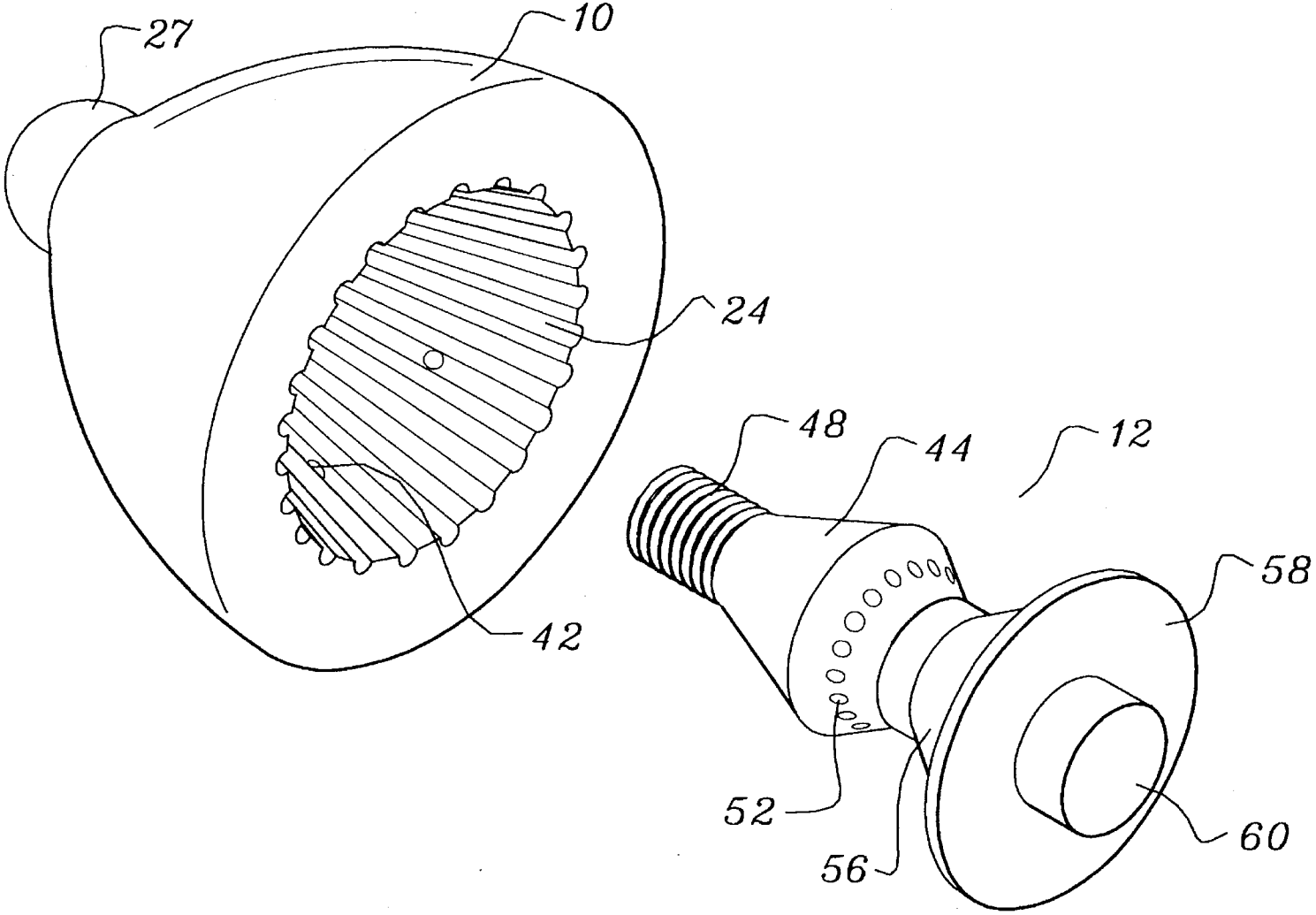
FIG. 1 is a perspective exploded view of the present invention.

With reference to the exploded perspective view of FIG. 1, the basic components of the present invention, namely, showerhead body (SHB) 10 and frusto-conical plug 12, may be seen.

Figure 2:
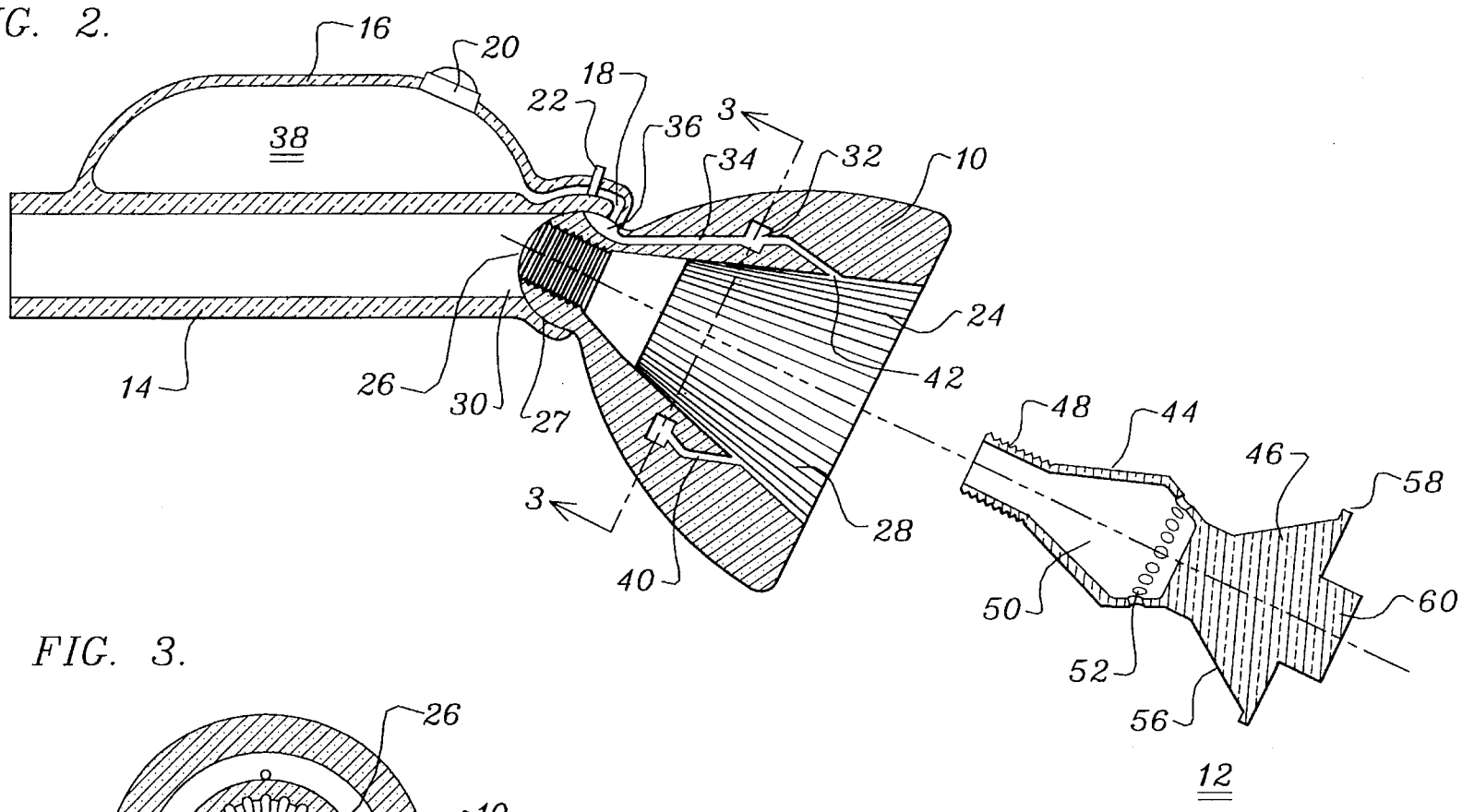
FIG. 2 is an axial cross-sectional exploded view.
Figure 3:
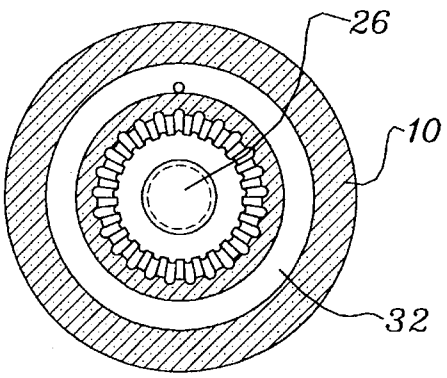
FIG. 3 is a radial cross-sectional view taken along line 3—3 of FIG. 2.

As may be noted in FIG. 1 and, further, in FIGS. 2 and 3, the inventive showerhead and soap dispensing system includes an input conduit 14 of pressurized water. Further provided, as may be noted in FIG. 2, is a re-fillable soap containing enclosure 16 having an output aperture 18, more fully described below. The enclosure 16 is preferably filled with a five percent soap solution which permits it to pass readily through the SHB 10. The enclosure 16 is provided with a window 20, through which the contents thereof may be observed, and with a release means 22 which is used to facilitate the opening of the enclosure 16 for purposes of refill thereof.

As may be seen in FIGS. 2 and 3, SHB 10 exhibits a frusto-conical form which includes a venturi-defining bore surface 24 which is ridge-like in character and, as such, has been found to have favorable properties of diffusion of the water and liquid which are accelerated axially outward as the venturi-surface 24 expands in axial dimension.

As may be noted, SHB 10 includes an axial water input 26 at apex of surface 24 and exhibits a water output 28 at the base thereof. As may be noted in FIG. 2, outer apex 27 of SHB 10 is proportioned for universal joint co-action with the interior diameter of output end 30 of the input conduit 14 of pressured water. Accordingly, SHB 10 may be rotated in a swivel or other fashion that is, in two rotational degrees of freedom, relative to said output 30 of pressurized water of input conduit 14.

Said SHB 10 further includes an internal annular channel 32 which is located in a radial plane of the SHB 10. Said annular channel 32 is fed by a soap receiving conduit 34 which originates from an input 36 which, as may be noted, is in fluid communication with output aperture 18 of soap-containing enclosure 16. Accordingly, soap is fed from a reservoir area 38 of the enclosure 16, through output aperture 18, into input 36 of conduit 34 and, therefrom, into annular channel 32 which, as may be noted, completely encircles a single plane of the SHB (see FIG. 3). From channel 32, liquid soap advances through circumferential conduit 40 and exits the SHB 10 through output apertures 42. As may be noted, said apertures 42 are disposed in a polar geometry within a radial plane which is downstream of the radial plane of said annular channel 32.

Figure 4:
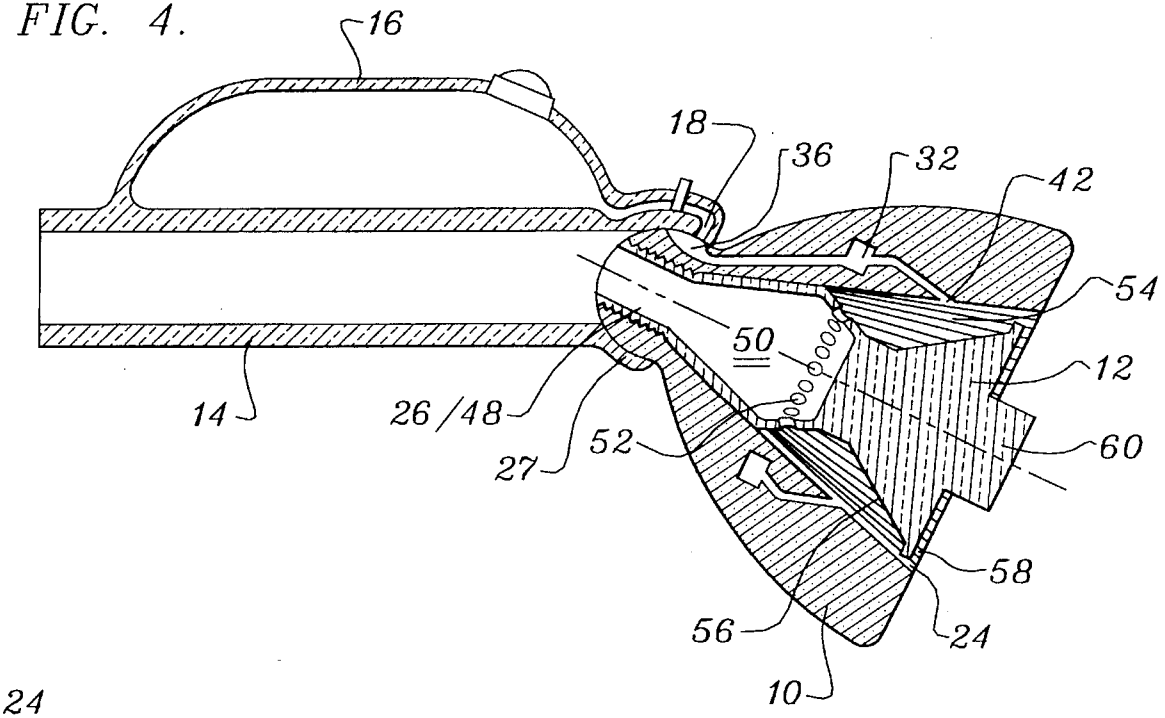
FIG. 4 is an assembly axial cross-sectional view of the inventive system.

The instant invention is further characterized by said frusto-conical plug 12 which, as may be noted with reference to FIGS. 2 and 4, includes a hollow upstream portion 44 and an integrally formed solid downstream portion 46. The upstream portion 44 exhibits a water input or mouth 48 which is proportioned for rotatable registration within said axial water input 26 of the SHB 10. Said hollow upstream portion 44 also includes an internal venturi chamber 50 that imparts acceleration to the flow-through of water. At a downstream end of hollow portion 44 of plug 12 are, within a defined radial plane, disposed a polar multiplicity of water exit apertures 52 from which water from venturi chamber 50 of plug 12 will accelerate into an annular lathering chamber 54. More particularly, as may be noted in the view of FIG. 4, said water exit apertures 52 are in a radial plane which is close to the radial plane of annular soap containing channel 32. It is, however, to be noted that the axial position of the exit channels 52 may be varied as a function of positive or negative rotation of registration surface 48 of plug 10 with the water input 26 of SHB 10.

As may be further noted in FIG. 4, the radial plane of said water exit apertures 52 will, regardless of the extent of rotation of plug 12 relative to SHB 12, still occupy a radial plane which is upstream of the radial plane defined by liquid soap exit apertures 42.

Figure 5:
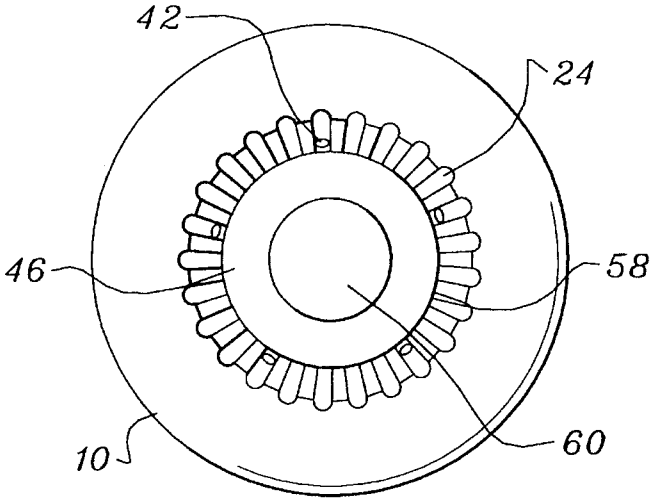
FIG. 5 is an axial front plan view of the system of FIG. 4.

With further reference to FIGS. 1 thru 4, it may be seen that said frusto-conical plug 12 further includes said solid downstream portion 46 which, upon an exterior thereof, defines a concave surface of rotation 56 which, as may be noted, flares radially outwardly in its downstream portion to define a maximum radius 58 such that, at said radial plane thereof, there exists a narrow annular channel which may be seen in the views of FIGS. 4 and 5. As such, the combination of concave surface of rotation 56 of portion 46 of plug 12 and venturi-defining ridge surface 24 of SHB 10, define a lathering chamber 54 which receives pressurized water input from apertures 52 and soap input from apertures 42. As such, a lathering effect will occur within annular concave chamber 54 and, therefrom, a pressurized output will occur through the annular exit therefrom which exists between maximum radius 58 of portion 46 of plug 10 and the venturi surface 24 of the SHB 10. As above noted, the lathering and general fluid flow characteristic may be adjusted through selective positive and negative rotation of plug 12 within SHB 10.

There is, at the downstream-most part of downstream portion 46 of plug 12, provided a control knob 60 which may be used to control the extent of registration of threaded plug surface 48 and the threaded surface of input 26 of SHB 10. It is to be appreciated that control knob 60 may assume any of a variety of different geometries.

It should also be appreciated that concave surface of rotation 56 may also assume various geometries within the contemplation of the present invention.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

Having thus described my invention what I claim as new, useful and non-obvious and, accordingly, secure by Letters Patent of United States is:

1. A showerhead and soap dispensing system, including an input conduit of pressurized water and a refillable soap containing enclosure having an output thereof, the system comprising:

(a) a frusto conical-body including a venturi-defining bore surface, said body including an axial water input at an apex thereof, said body including a water output at a base thereof, said body further including an internal annular channel in a radial plane of said body, said channel having a soap-receiving input conduit upstream of said channel and in fluid communication with said output of said soap-containing enclosure, said annular channel having, within said shower head body, a polar plurality of output apertures in a radial plane downstream of said channel; and (b) a frusto-conical plug comprising:

(i) a hollow upstream portion having a mouth proportioned for rotatable registration within said axial fluid input of said body, said hollow portion of said plug including, at a downstream radius thereof, a polar multiplicity of water exit apertures disposed, upon registration of said plug within said body, upstream of said soap output apertures of said annular channel of said body; and (ii) a downstream solid portion integral with said upstream hollow portion, said downstream portion having an external concave surface of rotation which, in combination with said venturi bore surface of said body, defines an annular water and soap lathering chamber downstream of said water exit apertures of said upstream portion of said plug, said chamber including a radial plain defined by said polar plurality of soap output apertures, said concave surface of rotation widening outwardly toward said venturi-defining bore surface of said shower head body to thereby maximize fluid pressure within said lathering chamber, whereby the mixing characteristic of the respective water and liquid soap apertures within said lathering chamber may be adjusted by selectable rotation of said plug relative to said body.

2. The system as recited in claim 1, in which said plug further comprises:

a rotatable control knob upon a downstream-most external radius of said solid portion of said plug.

3. The system as recited in claim 2, in which said venturi-defining bore surface of said shower head includes radially oscillating ridge-like geometry.

4. The system as recited in claim 2, in which said hollow upstream portion of said plug includes a venturi chamber internal thereto.

5. The system as recited in claim 4, in which said refillable liquid soap containing enclosure depends integrally from said pressurized water input conduit.

6. The system as recited in claim 4, in which said axial fluid input at the apex of said shower head body comprises a surface proportioned for rotational swivel fit connection with an output of said input conduit of pressurized water.

* * * * *